United States Patent [19]

Castoldi

[11] 4,325,699

[45] Apr. 20, 1982

[54] SUCTION DEVICE FOR JET PROPULSION UNITS FOR A WATERCRAFT AND JET PROPULSION UNITS COMPRISING THE SAME

[75] Inventor: Luigi Castoldi, Abbiategrasso, Italy

[73] Assignee: Societa' Castoldi S.p.A., Milan, Italy

[21] Appl. No.: 96,560

[22] Filed: Nov. 21, 1979

[30] Foreign Application Priority Data

Nov. 29, 1978 [IT] Italy ..... 30331 A/78

[51] Int. Cl.[3] ..... B63H 11/02

[52] U.S. Cl. ..... 440/47

[58] Field of Search ..... 115/12 R, 12 A, 14–16; 114/151; 60/221–222; 440/38–43, 46–47

[56] References Cited

U.S. PATENT DOCUMENTS

| | | | |
|---|---|---|---|
| 2,149,155 | 2/1939 | Anderson | 440/47 |
| 3,174,454 | 3/1965 | Kenefick | 115/16 |
| 3,187,708 | 6/1965 | Fox | 115/12 R |
| 3,207,116 | 9/1965 | France | 115/12 R |
| 3,336,752 | 8/1967 | Smith | 115/16 |

*Primary Examiner*—Trygve M. Blix
*Assistant Examiner*—Jesus D. Sotelo
*Attorney, Agent, or Firm*—Wenderoth, Lind & Ponack

[57] ABSTRACT

A suction device for a jet propeller assembly for a boat comprises a motor actuating a pump assembly and a suction conduit conveying water to the pump assembly. The suction inlet is located aft of the boat stern transom and has a rectangular minimum height cross-section with width to height ratio of 3 to 6. Preferably the suction inlet is located entirely rearwardly of the stern transom, the minimum height cross-section plane makes a 30° to 60° angle with the horizontal and the distance between the forward edge of the suction inlet and the pump inlet cross-section is not greater than twice the inlet cross-section diameter. Thus the suction device can be displaceably mounted with respect to the hull, no opening in the keel of the hull is necessary and the suction conduit can be located entirely aft of the stern transom. The propeller assembly efficiency and the wake dynamics are improved.

20 Claims, 6 Drawing Figures

SUCTION DEVICE FOR JET PROPULSION UNITS FOR A WATERCRAFT AND JET PROPULSION UNITS COMPRISING THE SAME

BACKGROUND OF THE INVENTION (a) The Field of the Invention

The present invention has as its object a suction device for jet propeller assemblies for boats, which may be shortly called "hydrojets", as well as the propeller assemblies themselves.

(b) The Prior Art

As is known, and as will be better explained hereinafter, in the known jet propulsion boats (hydrojets) of the gliding keel or displacement type, a motor mounted in the boat controls through a transmission a pump assembly (which comprises an impeller which sucks the water as well as a guide casing and discharge nozzle through which the accelerated water is discharged, thereby producing the desired jet effect) which is mounted at a certain distance from the stern plate of the hull, and between the pump assembly and the hull a static device—which will be called "suction conduit"—is inserted, which has the function of permitting the suction of the water and its delivery to the pump assembly. The suction conduit begins with a suction inlet which, in the hydrojets presently manufactured, is inserted and penetrated into an opening in the hull bottom, and the aforesaid suction conduit is structured as a connection between the suction inlet and an inlet cross-section of the pump assembly, which guides the water stream from the former to the latter.

The hydrodynamic phenomena which occur in devices of this kind are extremely complex, and comprise viscous, turbulent and eddy phenomena. The thickness of the limit layer and the accelarations or decelerations which occur have a decisive effect on the efficiency of the propeller assembly. Without entering into theoretical details which would not be helpful in understanding the invention, it may be said that one of the preoccupations of the builders of hydrojets is to keep the flowing water stream from becoming detached from the walls of the suction conduit and to prevent possible cavitation phenomena. For this reason it has always been thought necessary to provide the aforesaid suction conduit with walls having an extremely mild and gradual curvature, as it was believed that otherwise the water stream would have become detached from the walls. As a consequence-as will be better explained hereinafter-the suction conduit has in the past been considerably extended in length. Further, the suction conduit penetrates into the hull, since, as has been said, the suction inlet is substantially an opening in the keel of the hull, and this invloves rather drastic construction and assembly limitations. Because of the rigid geometry of the resulting assembly, the position of the pump assembly with respect to the suction conduit is rigidly fixed as is the position of the conduit with respect to the hull.

SUMMARY OF THE INVENTION

The present invention has as an object the elimination of the aforesaid limitations and of the consequent drawbacks, and in particular the elimination of the necessity of providing an opening in the keel of the hull, of rigidly bounding the propeller assembly to the hull, and of attributing to the suction conduit a considerable length.

Another object of the invention is to make it possible to locate the suction conduit entirely aft of the stern transom, without interrupting the rearmost template of the hull.

The elimination of the keel openings and of interruptions in the stern template structure improve the structural strength of the hull and considerably simplify its construction.

These and other objects of the invention, which will be better understood from the following description, are achieved without lowering at all the efficiency of the propeller assembly. On the contrary, the invention tends to increse efficiency and provides a hydrodynamic improvement of the wake, as will be further explained.

The structure of the suction conduit of the jet propeller assembly, according to the invention, is characterized in that the suction inlet is essentially positioned aft of the stern transom of the boat and has a cross-section having a minimum dimension in a vertical plane passing through the axis of the boat, which will be called hereinafter "minimum height cross-section", which cross-section is rectangular and has a ratio of width to height, i.e. of the essentially horizontal dimension to the essentially vertical dimension, comprised between 3 and 6 and preferably between 4 and 5.

Preferably the suction inlet is entirely located aft of the stern transom. However, the invention may also be carried into practice in such a way as to reduce the penetration of the inlet into the hull without completely eliminating it.

According to a preferred aspect of the invention, the plane in which the minimum height cross-section lies makes an angle comprised between 30° and 60° and preferably between 40° and 50° with the horizontal.

According to another preferred aspect of the invention, the distance between the forward edge of the suction inlet—which in this case preferably coincides with the rear edge of the stern template—and the inlet cross-section of the pump assembly, which is located on the terminal outlet plane of the suction conduit, does not exceed twice the diameter of the inlet cross-section and is preferably less than that, and is typically about 1.8 times such diameter.

BRIEF DESCRIPTION OF THE DRAWINGS

Other characteristics, aspects and advantages of the invention will be better understood from the following description of a preferred, non limitative, embodiment, with reference to the attached drawings, wherein.

and

Figure 3:
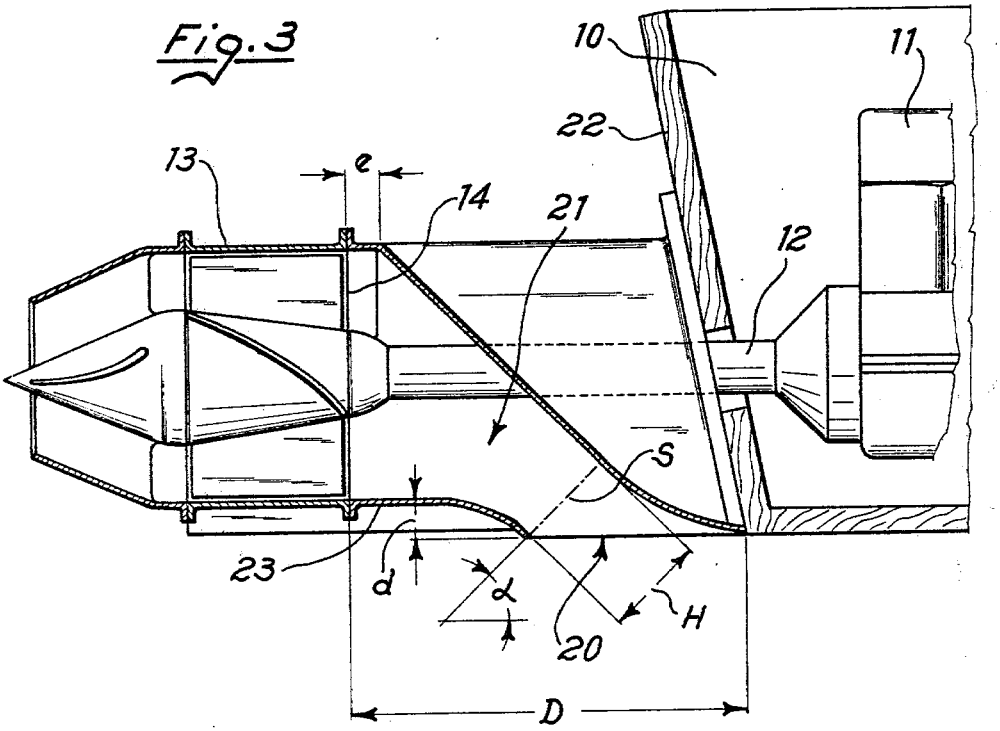
FIG. 3 is a cross-section similar to FIG. 1 but illustrating an embodiment of the invention.
Figure 6:
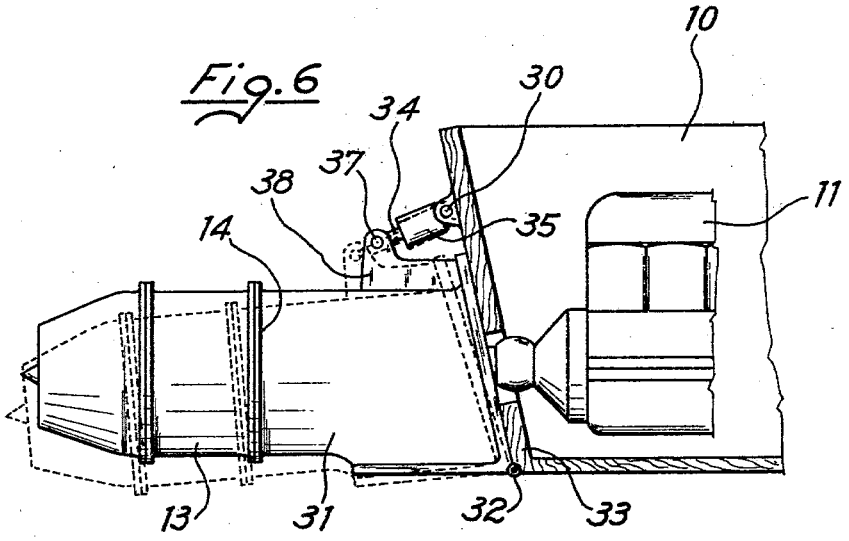

FIG. 6 is a view similar to FIG. 3 but illustrates a variant of the invention.

DETAILED DESCRIPTION OF THE INVENTION

Figure 1:
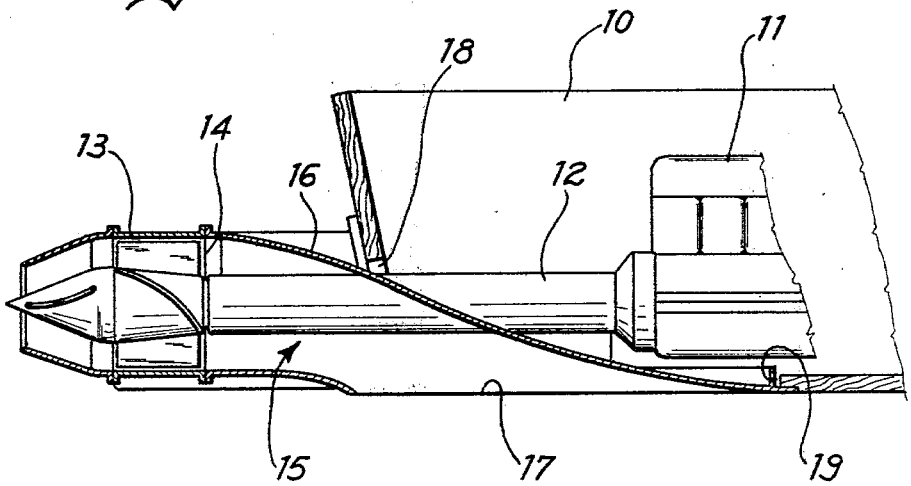
Fig. 1 PRIOR ART
FIG. 1 is an axial cross-section, partly in elevation, of the rear portion of a hull, with a propeller assembly and suction conduit according to the prior art.
Figure 2:
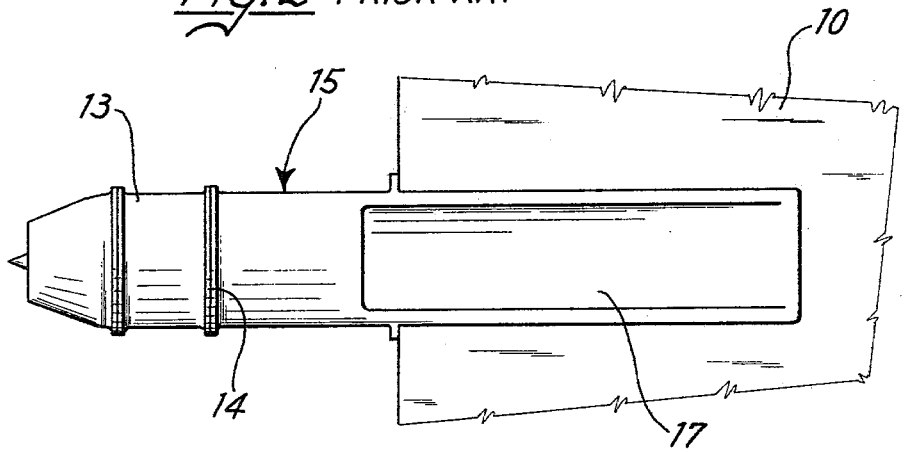
Fig. 2 PRIOR ART
FIG. 2 is a plan view from the bottom of the devices of FIG. 1.

With reference now to FIGS. 1 and 2, a hydrojet according to the known art essentially comprises the following devices.

On hull 10 motor 11 is mounted (hull and motor being only partially shown for the sake of simplicity) which motor actuates pump assembly 13 through a transmission 12. The inlet cross-section 14 of the pump assembly is naturally circular and between it and the hull the suction conduit, indicated at 15, is interposed. This latter has a wall 16 which extends in vertical cross-section with a mild curvature, as seen in FIG. 1, connecting the inlet cross-section 14 of the pump assembly to the suction inlet 17 defined by the intersection of a horizontal plane, substantially located at the level of the bottom of the hull, with the suction conduit.

As it is seen, the suction inlet 17 is considerably elongated and relatively narrow, its width approximately corresponding to the diameter of the inlet cross-section of the pump assembly. Because of this conformation, conduit 15 must be inserted into the hull and the hull is cut off at the stern transom as indicated at 18 and at the keel as indicated in 19, or the conduit penetrates the hull in other equivalent ways. In known constructions, it is not possible to avoid cutting off the hull and partially penetrating the suction conduit into the hull, since otherwise the great length of the conduit would cause the pump assembly to be too far from the hull. For the same reasons the conduit is placed in an invariable position with respect to the hull and is rigidly mounted thereon, resulting in a rigid and invariable geometric relationship between the propeller assembly and the hull.

Figure 4:
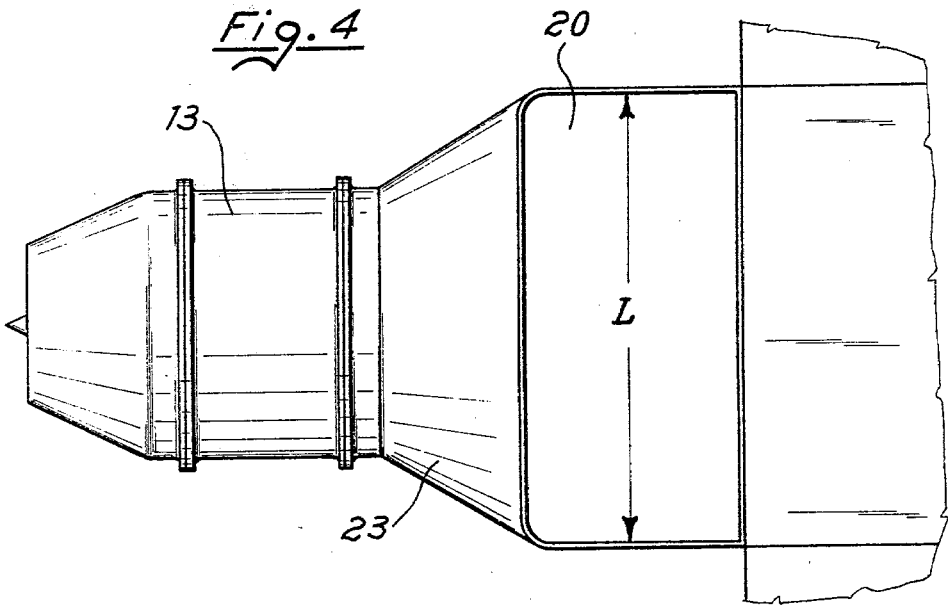
FIG. 4 is a plan view from the bottom of the devices of FIG. 3.

FIGS. 3 and 4 are similar to FIGS. 1 and 2 but illustrate a device according to the invention. The hull, the motor, the transmission and the pump assembly are designated by the same numerals as FIG. 1 and 2 and are in principle identical.

However the hull is not cut off either at the keel or in at the stern transom (except insofar as required for permitting the transmission 12 to pass through). Suction conduit 21 has a suction inlet 20 which is entirely located aft of the hull and in a horizontal plane. Obviously, in the present description the words "horizontal" and "vertical" refer to the ideal set of the boat, in absolutely still water.

The critical parameters of the invention refer to the minimum height cross-section, as hereinbefore defined, of the suction inlet, that is the cross-section which passes through the rear edge of the suction inlet and is perpendicular to the axis of the suction conduit and has its minimum dimension in a vertical plane (the plane of FIG. 3). This cross-section, indicated by S in the drawings, lies on a plane which will be called "normal", which forms an angle $\alpha$ with the horizontal, i.e. with the plane of the suction inlet 20. In this normal plane the cross-section of the suction conduit is rectangular and has a dimension "H" contained in a longitudinal plane of the boat, i.e. in the vertical plane (of FIG. 3), and a dimension "L" perpendicular thereto (FIG. 4). According to the invention the ratio L/H is comprised between 3 and 6 and preferably between 4 and 5.

Preferably according to the invention, the angle $\alpha$ is comprised between 30° and 70° and more preferably between 40° and 50°.

The shape of the suction conduit changes from the suction inlet to the inlet cross-section 14 of the pump group, where it becomes circular. The area of the cross-section, in the typical cases, remains approximately or essentially unchanged.

The precise conformation of the walls of the conduit, is decided by the boat builders, based on project considerations which are not a part of the invention, and the same considerations may suggest moderate variations of the suction conduit cross-sections.

Preferably according to the invention the ratio of the distance "D" (FIG. 3) between the plane of cross-section 14 and the forward edge of the suction inlet to the diameter 2R of inlet cross-section 14, is not more and is preferably less than 2 and typically may be about 1.8.

The distance "d" between the plane of the suction inlet 20 and the minimum level of the wall 23 of the suction conduit is not critical and is generally kept as small as possible compatible with construction requirements, various constructive solutions being possible in practical cases. Usually it is not larger than H/2 and may be smaller.

The distance "e" between the plane of cross-section 14 and the plane at which the suction conduit acquires the inlet cross-section of the pump assembly is also not critical and is a matter of constructive convenience. It may even be zero, or the suction conduit may be connected to the inlet cross-section by a curved wall, in which case "e" cannot be defined.

Figure 5:
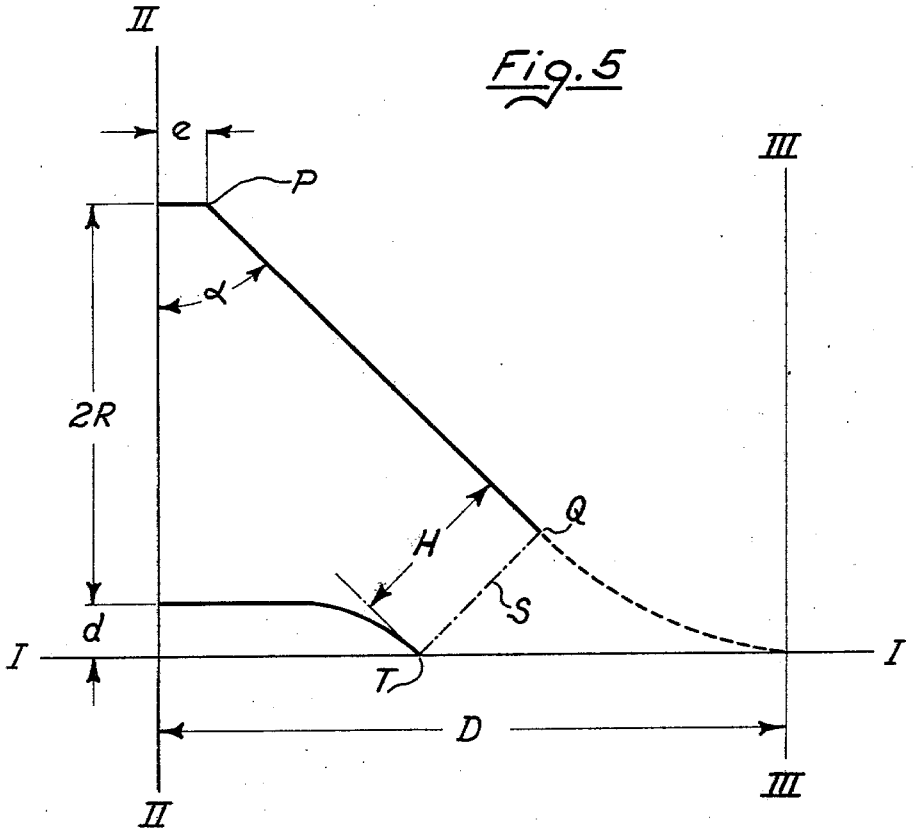
FIG. 5 is a schematic illustration of some geometric characteristics of the invention.

FIG. 5 shows how the quantitative parameters hereinbefore set forth make it possible completely to determine the geometry of the suction conduit. Firstly, the plane I—I on which the hull bottom lies and the inlet opening 20 must lie is traced. Then the plane II—II on which the pump assembes inlet cross-section 19 lies, is traced perpendicularly to plane I—I in an arbitrary position. The forward edge of the suction inlet 20 will be on the intersection of plane I—I with a plane III—III parallel to plane II—II and at a distance "D" therefrom. The diameter 2R of the pump assembly inlet cross-section is determined by the structure and the power of the assembly and is an independent starting datum, insofar as the invention is concerned. Once the distances "d" and "e" have been fixed so as to satisfy constructional requirements, the line which is the top boundary of the longitudinal cross-section of the connecting conduit will pass through a point P which is at a distance "e" from plane II—II and at a distance 2R+d from plane I—I. Such line therfore will be the line passing through P and making an angle $\alpha$ with the vertical. Where the perpendicular to the line thus traced crosses plane I—I at a distance H from such line, the minimum height cross-section S will be located. The highest point Q of this cross-section will have to be conveniently connected with the intersection of planes I—I and III—III, and the axial cross-section of the suction conduit is completed by tracing a line parallel to plane I—I at the distance "d" therefrom and connecting such line with the point T which represents the rear edge of the suction inlet 20. The construction does not vary if the straight segment "e" is replaced by a curve.

Only the dimension "L" remains to be determined to complete the construction of the suction inlet and conduit. This is done by adopting any desired L/H ratio within the limits of the invention. Then the cross-section S is completely defined, and can be connected with the circular inlet 14 by walls having any shape suggested by the particular preferences of the designer and by considerations which do not concern the invention.

Obviously, once the ratio L/H has been fixed, both these values have been fixed since project considerations independent of the invention will determine in each case the product HxL which often is, at least approximately, equal to $\pi R^2$.

The values $\alpha$ and "D" are fixed within the limits defined by the invention, while the distances "d" and "e" are not critical and are determined according to constructive convenience.

FIG. 6 illustrates how the invention makes it possible to vary the relative direction and the inclination of the pump assembly with respect to the hull. This makes it possible to adapt the direction of the thrust to any particular centering of the hull, and therefore permit a better adjustment. The position of the pump assembly, once adjusted, may remain fixed, or it may still be variable by using devices which may be registered both when the boat is at a standstill and when it is in motion.

This may be easily done in many ways evident to persons skilled in the art, thanks to the fact that the pump assembly is mounted on the suction conduit and this latter is mounted on the stern of the hull without being rigidly bound thereto. An example of a suitable construction is illustrated in FIG. 6 which is similar to FIG. 3, except that the suction conduit, herein designated by numeral 31, is hinged at 32 on the stern 33 of the hull and is displaceable by small rotations about hinge 32 by any convenient means, e.g. by means of a rod 34 fixed to a piston of a hydraulic cylinder 35 hinged at 30 to the hull, the rod 34 being hinged at 37 to a lug 38 of conduit 31. The piston may be displaced by pumping liquid into the cylinder or removing it therefrom, to cause rod 34 to protrude more or less from the cylinder to rotate the suction conduit and the pump assembly, two positions of which are shown, in full and broken lines, in the figure. Other mechanical means for the same purpose may easily be devised to effect the displacements of the suction conduit and pump assembly which are rendered possible by the invention.

It is seen therefore that the invention achieves all its purposes and in particular it makes it possible to leave the hull unaffected without providing therein an opening for the suction inlet, to mount the suction conduit entirely aft of the stern transom, to shorten the conduit, and so on.

It has been found that, contrary to what the state of the art suggested, the use of a shortened suction conduit, which has much sharper curvatures, does not involve any hydrodynamic disadvantage, does not reduce the efficiency and does not cause the liquid veins to become detached from the walls of the conduit, i.e. does not cause cavitation, provided that the dimensional parameters of the invention are observed.

Not only does the efficiency of the hydrojet not decrease, but surprisingly it increases, one reason being that the limit layer of a considerable portion of the water flow below the hull is sucked in by the device according to the invention and therefore the dynamics of the wake are improved.

Further, the motor may be mounted in a more rearwardly position, whereby the space available in the boat is increased and, in the case of gliding hulls, the speed increases for any given thrust.

The complexity of the hydrodynamic phenomena which occur in devices of this kind does not permit a rigorous quantitative theoretical discussion and the Applicant does not wish to be in any way bound to any scientific explanation, but the satisfactory hydrodynamic behaviour of the devices according to the invention and the hydrodynamic progress which they provide are experimentally ascertained facts.

An embodiment of the invention has been described but it may be carried out with many variations and adaptations by persons skilled in the art.

I claim:

1. A suction device for use in a boat jet propeller assembly of the type including a motor to be mounted forward of a stern transom of a boat, a pump assembly to be mounted aft of the stern transom, and a transmission connecting said motor to said pump assembly for rotation thereof to cause pumping of water and jet discharge thereof, said suction device comprising:

a suction conduit for conveying water to the pump assembly upon operation thereof, said suction conduit having a suction inlet adapted to be positioned substantially aft of the stern transom of the boat and a suction outlet adapted to be connected to an inlet cross-section of the pump assembly, said suction inlet adapted to be located in a generally horizontal plane substantially level with the bottom of the hull of the boat, said suction conduit having a minimum height cross-section having a minimum dimension in a vertical plane passing through the axis of the boat, said minimum height cross-section being rectangular and lying in a plane passing through the rear edge of said suction inlet and extending perpendicular to the axis of said suction conduit, and the ratio of width to height of said minimum height cross-section being between 3 and 6.

2. A suction device as claimed in claim 1, wherein the area of the cross-section of said suction conduit is substantially equal to the inlet cross-section of the pump assembly.

3. A suction device as claimed in claim 1, wherein said ratio is between 4 and 5.

4. A suction device as claimed in claim 1, wherein said suction inlet is positioned entirely rearwardly of the stern transom of the boat.

5. A suction device as claimed in claim 1, wherein said minimum height cross-section lies in a plane extending to the horizontal at an angle of between 30° and 60°.

6. A suction device as claimed in claim 5, wherein said angle is between 40° and 50°.

7. A suction device as claimed in claim 1, wherein the distance between the forward edge of said suction inlet and the inlet cross-section of the pump assembly is not greater than twice the diameter of the inlet cross-section.

8. A suction device as claimed in claim 7, wherein said distance is less than twice the diameter of the inlet cross-section.

9. A suction device as claimed in claim 1, further comprising means for varying the position of said suction conduit with respect to the hull of the boat.

10. A suction device as claimed in claim 9, wherein said means comprises structure for varying the angular position of said suction conduit with respect to the hull of the boat.

11. A jet propeller assembly for use on a boat, said jet propeller assembly comprising:

a motor to be mounted forward of a stern transom of a boat;

a pump assembly to be mounted aft of the stern transom;

transmission means, connected between said motor and said pump assembly, for rotating said pump assembly to cause pumping of water and jet discharge thereof; and a suction conduit for conveying water to said pump assembly upon operation thereof, said suction conduit having a suction inlet to be positioned substantially aft of the stern transom and a suction outlet connected to an inlet cross-section of said pump assembly, said suction inlet being located in a generally horizontal plane extending substantially level with the hull of the boat, said suction conduit having a minimum height cross-section having a minimum dimension in a vertical plane passing through the axis of the boat, said minimum height cross-section being rectangular and lying in a plane passing through the rear edge of said suction inlet and extending perpendicular to the axis of said suction conduit, and the ratio of width to height of said minimum height cross-section being between 3 and 6.

12. An assembly as claimed in claim 11, wherein the area of the cross-section of said suction conduit is substantially equal to said inlet cross-section of said pump assembly.

13. An assembly as claimed in claim 11, wherein said ratio is between 4 and 5.

14. An assembly as claimed in claim 11, wherein said suction inlet is positioned entirely rearwardly of the stern transom of the boat.

15. An assembly as claimed in claim 11, wherein said minimum height cross-section lies in a plane extending to the horizontal at an angle of between 30° and 60 °.

16. An assembly as claimed in claim 15, wherein said angle is between 40° and 50°.

17. An assembly as claimed in claim 11, wherein the distance between the forward edge of said suction inlet and said inlet cross-section of said pump assembly is not greater than twice the diameter of said inlet cross-section.

18. An assembly as claimed in claim 17, wherein said distance is less than twice the diameter of said inlet cross-section.

19. An assembly as clamined in claim 11, further comprising means for varying the position of said suction conduit with respect to the hull of the boat.

20. An assembly as claimed in claim 19, wherein said means comprises structure for varying the angular position of said suction conduit with respect to the hull of the boat.

* * * * *